US011566352B2

(12) United States Patent
Myogi et al.

(10) Patent No.: US 11,566,352 B2
(45) Date of Patent: Jan. 31, 2023

(54) FRAME OF LOOM

(71) Applicant: TSUDAKOMA KOGYO KABUSHIKI KAISHA, Ishikawa-ken (JP)

(72) Inventors: Keiichi Myogi, Ishikawa-ken (JP); Daigo Yamagishi, Ishikawa-ken (JP); Koichi Tamura, Ishikawa-ken (JP); Kazuya Yama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 11 days.

(21) Appl. No.: 17/410,478

(22) Filed: Aug. 24, 2021

(65) Prior Publication Data

US 2022/0098766 A1 Mar. 31, 2022

(30) Foreign Application Priority Data

Sep. 30, 2020 (JP) ..... JP2020-165232

(51) Int. Cl.
*D03D 49/02* (2006.01)
*D03C 13/00* (2006.01)

(52) U.S. Cl.
CPC ..... *D03D 49/02* (2013.01)

(58) Field of Classification Search
CPC ..... D03D 49/02; D03D 49/027; D03J 1/14
See application file for complete search history.

(56) References Cited

U.S. PATENT DOCUMENTS 644,322 A * 2/1900 Goldschmidt ..... D03J 1/14 28/198
669,394 A * 3/1901 Keene ..... D03J 1/14 28/208
1,191,112 A * 7/1916 Peterson ..... D03J 1/14 28/205
1,342,896 A * 6/1920 Colman ..... D03J 1/14 28/208

(Continued)

FOREIGN PATENT DOCUMENTS

CN 1498996 A 5/2004
GB 213905 A 1/1925
JP 2004-084110 A 3/2004

OTHER PUBLICATIONS

Feb. 15, 2022, European Search Report issued for related EP Application No. 21193829.5.

*Primary Examiner* — Robert H Muromoto, Jr.
(74) *Attorney, Agent, or Firm* — Paratus Law Group, PLLC

(57) ABSTRACT

A frame of a loom includes both side frames connected to each other by means of a plurality of beam members attached to attachment parts on inner surfaces of each of the side frames, and each side frame is configured to support a heddle frame guide configured to guide up-and-down movement of a heddle frame of an opening device. In the frame of a loom, at least one of the pair of side frames has, as a reference surface, a part located in a position of the inner surface in which the heddle frame guide in a warp direction is supported and the attachment part to which at least one of the plurality of beam members is attached is formed to be an offset attachment part located on a more inner side of the frame than the reference surface.

2 Claims, 4 Drawing Sheets

(56) References Cited

U.S. PATENT DOCUMENTS

| | | | | | |
|---|---|---|---|---|---|
| 2,048,974 | A * | 7/1936 | Smith | D03J 1/14 | 28/178 |
| 2,705,022 | A * | 3/1955 | Picanol | D03D 49/02 | 139/1 R |
| 2,835,276 | A * | 5/1958 | Hunt | D03D 49/025 | 139/1 R |
| 2,911,012 | A * | 11/1959 | Egli | D03D 49/02 | 139/97 |
| 5,738,150 | A * | 4/1998 | Roelstraete | D03D 49/027 | 139/1 C |
| 2002/0046777 | A1 * | 4/2002 | Hirai | D03C 13/025 | 139/57 |

* cited by examiner

FRAME OF LOOM

CROSS-REFERENCE TO RELATED APPLICATION

The present application claims priority from Japanese Patent Application No. 2020-165232, filed on Sep. 30, 2020, the entire subject matter of which is incorporated herein by reference.

TECHNICAL FIELD

The present invention relates to a frame of a loom including a pair of side frames connected to each other by means of a plurality of beam members attached to attachment parts on inner surfaces of each of the side frames, and each configured to support a heddle frame guide configured to guide up-and-down movement of a heddle frame of an opening device.

BACKGROUND ART

As disclosed in JP2004-084110A, fix example, a frame of a general loom is constituted by connecting a pair of side frames by means of a plurality of beam members. Specifically, the frame includes a pair of side frames each having a housing shape, and long beam members are attached to inner surfaces of each of the side frames, so that both the side frames are connected by means of the plurality of beam members.

The loom also includes a pair of heddle frame guides for guiding up-and-down movement of a heddle frame of an opening device. The heddle frame guides are provided on the loom in a form of being supported on each of the side frames of the frame.

Note that, the specification of the loom is defined based on a weaving width of a fabric to be woven. The heddle frame mounted on the loom has a width corresponding to the greatest weaving width that can be woven in the loom. In the loom, up-and-down movement of the heddle frame is guided by the pair of heddle frame guides, as described above. The heddle frame guides are each supported by means of brackets and the like each attached to the corresponding side frame.

For this reason, an interval between the pair of heddle frame guides is defined by positions of both the brackets in a width direction of the loom. Therefore, an interval between both the side frames to which the brackets are attached is set such that the pair of heddle frame guides supported on each of the side frames via the brackets is arranged at an interval at which they can guide the heddle frame as described above. Specifically, the interval between the pair of side frames of the frame is set such that the interval between positions in which the brackets are attached (positions in a warp direction, in which the heddle frame guides are supported) implements arrangement of the heddle frame guides as described above, and is determined based on the interval between the positions in which the brackets are attached taking into consideration a width of the heddle frame.

For reference, in most of the looms, the brackets are attached to the inner surfaces of the side frames. Specifically, a position of the side frame in which the bracket is attached is on the inner surface. In addition, the inner surface is substantially planar although there is slight unevenness.

SUMMARY OF INVENTION

However, in the loom, it is known that severe vibrations (so-called beating vibrations) occur on both the side frames in association with a beating operation during weaving because a rocking shaft for supporting a reed is supported on both the side frames. In the loom, the entire frame of the loom may be caused to severely vibrate as the beating vibrations occur, in some cases. Particularly, in recent years, an operation of the loom tends to increase in speed, and the vibrations become more severe as the operation speed of the loom increases. When the entire frame of the loom is caused to severely vibrate, each device supported on the frame vibrates to badly influence the weaving, so that a quality of the woven fabric to be woven is lowered.

The present invention has been made in view of the above situations, and an object thereof is to provide a frame of a loom having the frame constituted by both side frames connected by means of a plurality of beam members and capable of improving a vibration-proof characteristic against beating vibrations.

A preamble of the present invention is a frame of a loom including a pair of side frames connected to each other by means of a plurality of beam members attached to attachment parts on inner surfaces of each of the side frames, and each configured to support a heddle frame guide configured to guide up-and-down movement of a heddle frame of an opening device.

The present invention is characterized in that at least one of the pair of side frames has, as a reference surface, a part located in a position of the inner surface in which the heddle frame guide in a warp direction is supported and the attachment part to which at least one of the plurality of beam members is attached is formed to be an offset attachment part located on a more inner side of the frame than the reference surface.

In the frame of a loom according to the present invention, the plurality of beam members may include two winding-side beam members provided in different positions in an upper and lower direction on a further winding-side than the heddle frame guides, and the frame may be configured such that the offset attachment part is the attachment part to which an upper beam member of the winding-side beam members is attached.

According to the present invention, in the loom having the frame constituted by the pair of side frames connected by means of the plurality of beam members, as for at least one (hereinafter, referred to as "target beam member") of the plurality of beam members, the attachment part to which the target beam member is attached is formed to be an offset attachment part located on a more inner side in the width direction of the loom than the reference surface. Thereby, the frame is improved in terms of the vibration-proof characteristic against beating vibrations. This is more specifically described as follows.

As described above, as for a frame of a loom, an interval between a pair of side frames is determined based on an interval between positions in which brackets corresponding to each of the heddle frame guides are attached. Further, according to the present invention, as for at least one of the pair of side frames whose interval is determined in such a way, the attachment part to which the target beam member is attached is formed to be an offset attachment part located on the more inner side than the reference surface. Therefore, when the frame (side frame) is configured in such a way, a length dimension of the target beam member is reduced, as compared to a case where the frame is configured according to the related art.

The length dimension is reduced in this way, so that the target beam member is difficult to bend in an upper and lower direction and in a front and rear direction of the frame.

As a result, the frame constituted by the side frames connected by means of the beam members is difficult to vibrate in the upper and lower direction and in the front and rear direction, as a whole. That is, the vibration-proof characteristic of the frame is improved. Therefore, according to the frame, even in a state where the beating vibrations as described above occur on the frame having the configuration of the related art, the vibrations of the entire frame are reduced as much as possible, so that the lowering in quality of the woven fabric due to the vibrations can be prevented.

Further, in the frame of a loom of the present invention, the target beam member is set as the upper beam member of the two winding-side beam members provided in different positions in the upper and lower direction on the winding-side, i.e., the offset attachment part is set as the attachment part to which the upper beam member is attached, so that the vibration-proof characteristic of the frame can be more effectively improved.

Specifically, in the general loom, the support positions of the rocking shaft, which causes the beating vibrations, on the side frame are on the winding-side with respect to the heddle frame guide in the front and rear direction of the frame. For this reason, in the front and rear direction, a winding-side beam member, which is a beam member on the winding side with respect to the heddle frame guide, of the plurality of beam members is shorter in distance from the rocking shaft than a delivery-side beam member, which is a beam member on the delivery side with respect to the heddle frame guide, and is thus susceptible to an influence of the beating vibrations. In addition, each of the side frames is strongly fixed to a setup surface of the loom by means of anchor bolts. Therefore, vibrations are more likely to occur on an upper part than a lower part of each of the side frames. For this reason, when comparing the two beam members provided in different positions in the upper and lower direction, the upper beam member is more susceptible to the influence of the beating vibrations than the lower beam member.

From these things, the upper beam member of the winding-side beam members, which are the beam members susceptible to the influence of the beating vibrations of the plurality of beam members, is set as the target beam member, so that the vibration-proof characteristic of the frame can be more effectively improved.

DESCRIPTION OF EMBODIMENTS

Figure 1:
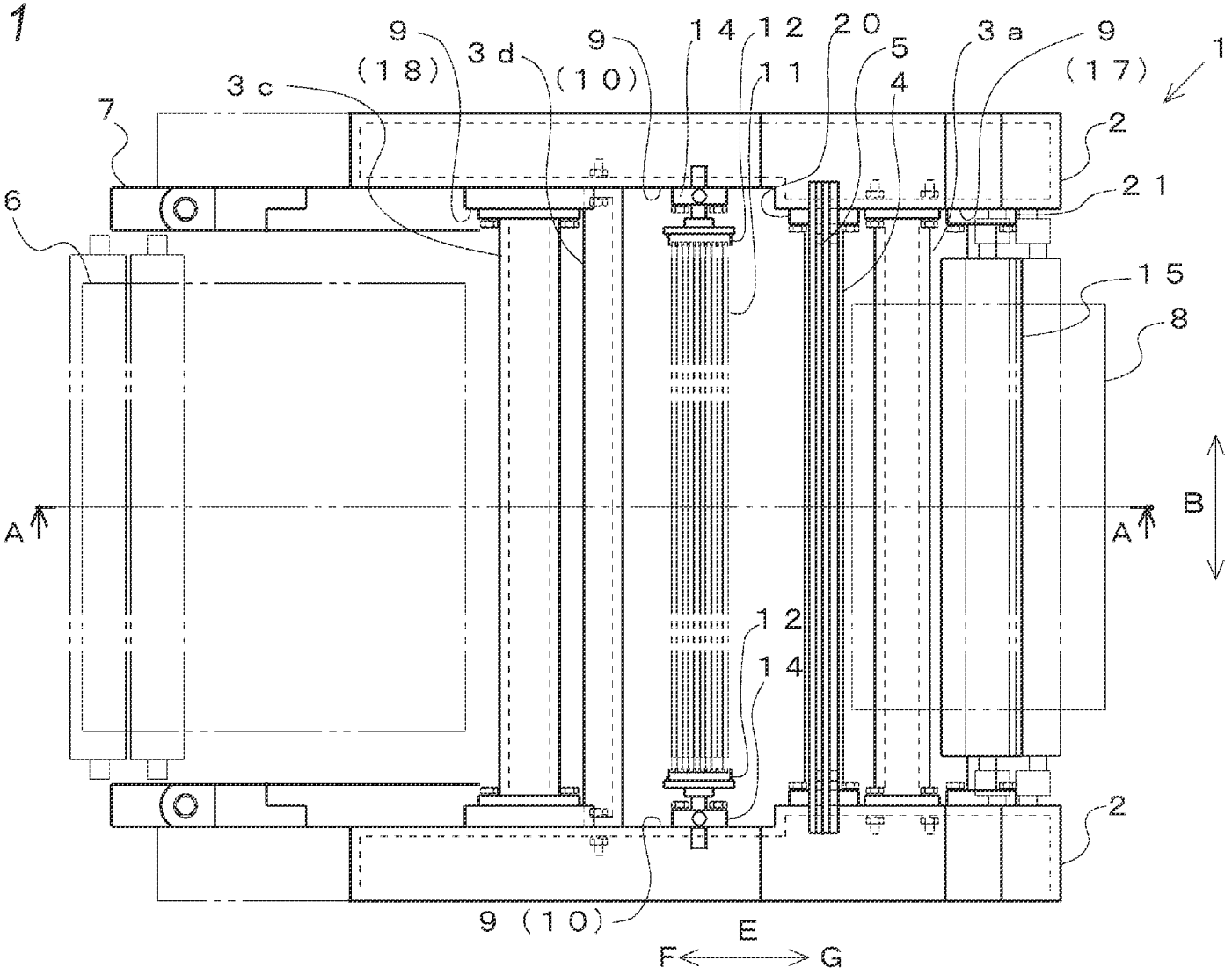
FIG. 1 is a top view of a frame of a loom to which the present invention is applied.
Figure 2:
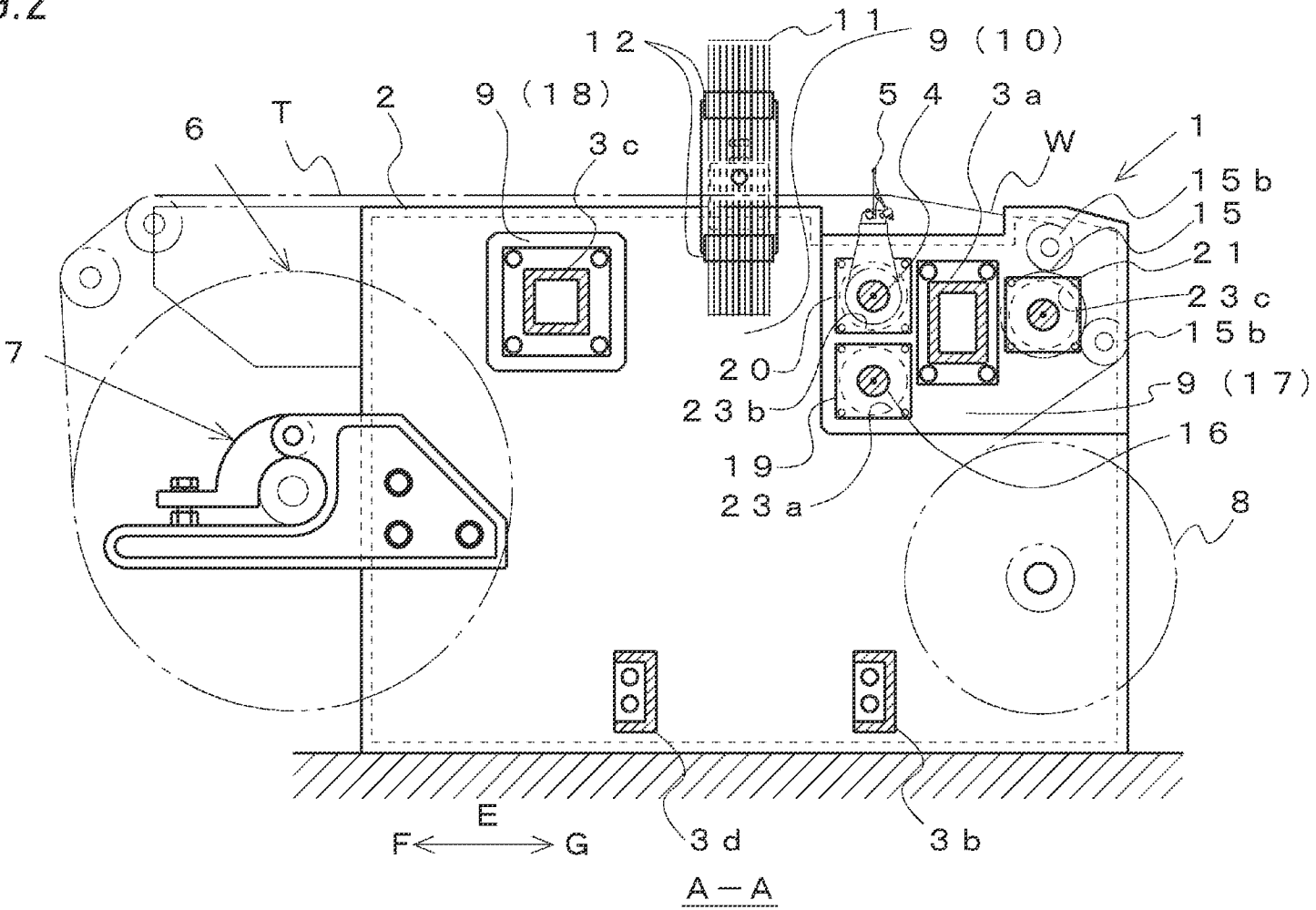
FIG. 2 is a sectional view taken alone an A-A line in FIG. 1.
Figure 3:
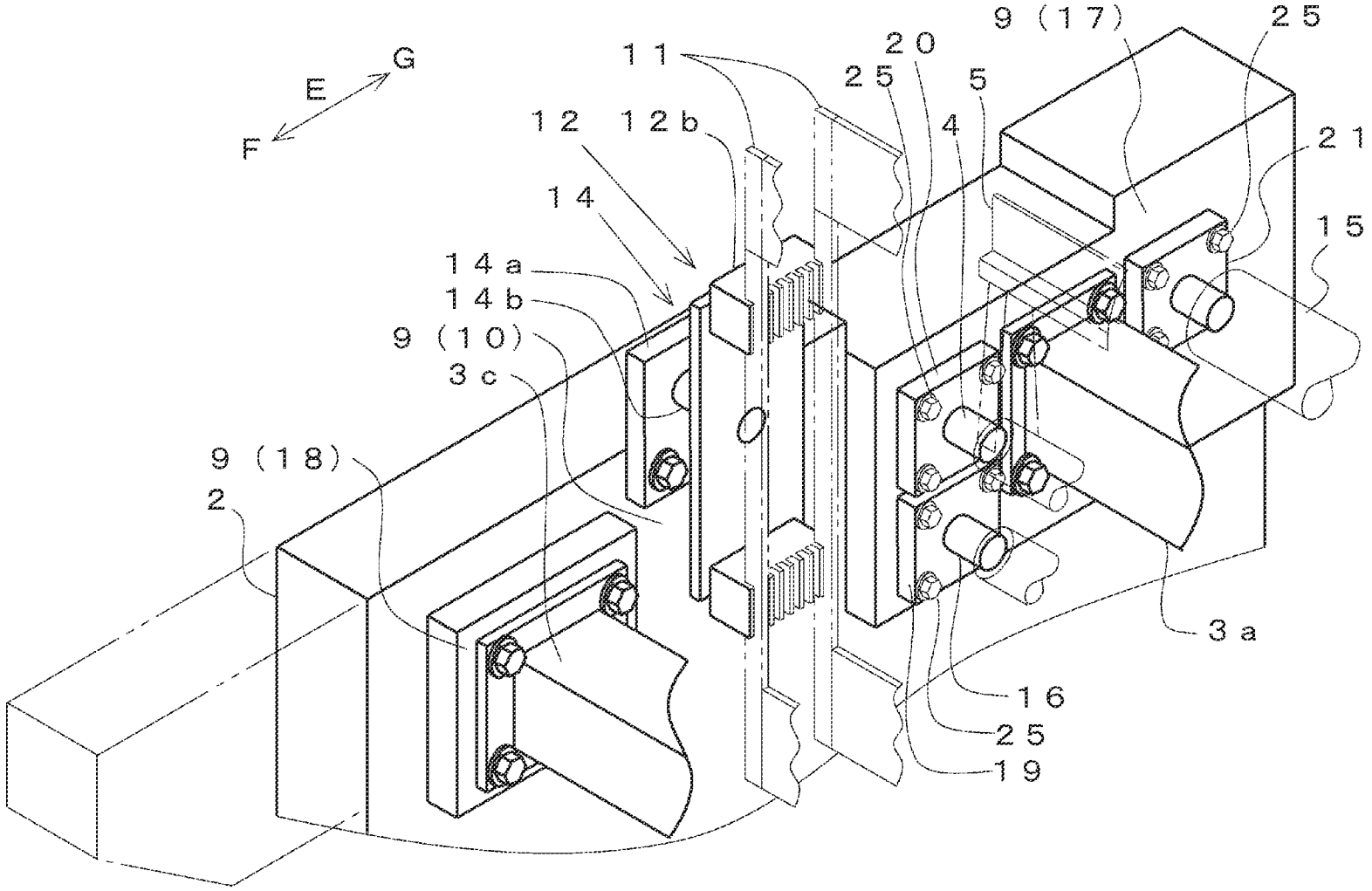
FIG. 3 is a partially enlarged perspective view of the frame of a loom shown in FIG. 1.
Figure 4:
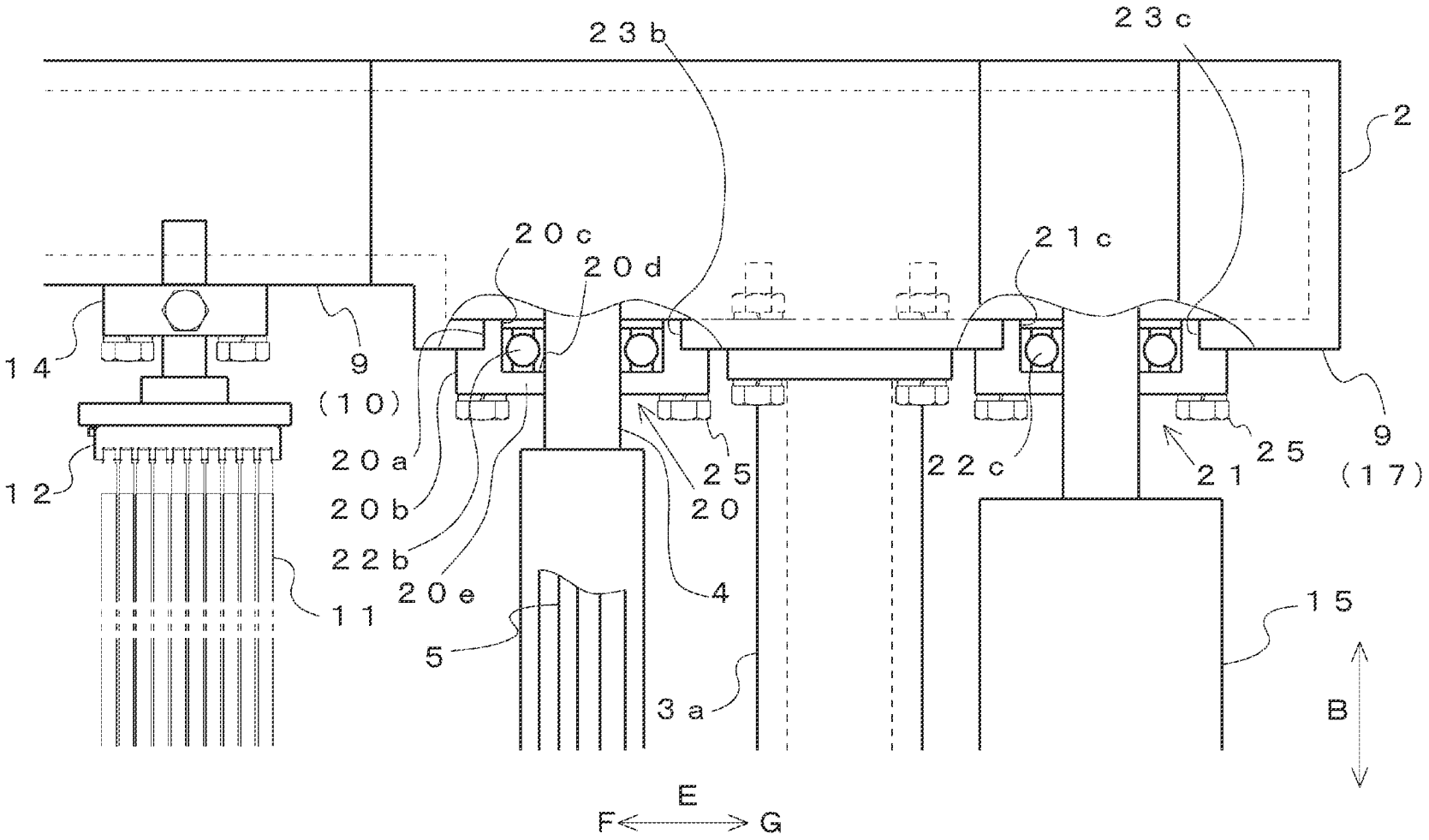
FIG. 4 is a partially enlarged sectional view of the frame of a loom shown in FIG. 1.

Hereinafter, an embodiment (the present embodiment) of a frame of a loom to which the present invention is applied will be described with reference to FIGS. 1 to 4.

In a loom, a frame 1 has a configuration where a pair of side frames 2 and 2 is provided as a main body and both the side frames 2 and 2 are connected by means of four beam members 3*a*, 3*b*, 3*c* and 3*d*. Note that, each of the side frames 2 has a housing shape having a space therein. Both the side frames 2 and 2 are connected by means of the beam members 3*a*, 3*b*, 3*c* and 3*d* with facing each other in a width direction (thickness direction=a width direction of the loom).

In the loom, a warp beam 6 for delivering a warp T is provided on one side in a front and rear direction of the loom in a form of being supported on both the side frames 2 and 2. In addition, a winding beam 8 for winding a manufactured woven fabric is provided on the other side in the front and rear direction of the loom in a form of being supported on both the side frames 2 and 2.

In addition, the loom has a pair of heddle frame guides 12 and 12 for guiding up-and-down movement of heddle frames 11 of an opening device. The heddle frame guides 12 are each provided on the loom in a form of being supported by means of brackets 14 each attached to the corresponding side frame 2. The brackets 14 are each fixed to the corresponding side frame 2 in a form of being fixed to an inner surface 9 of the side frame 2.

Note that, each of the brackets 14 is constituted by a plate-shaped support plate 14*a* attached to the frame and a support shaft 14*b* attached to the support plate 14*a* so as to protrude from one end face of the support plate 14*a*. Each of the brackets 14 is fixed to the inner surface 9 of the side frame 2 in such a form that the support shaft 14*b* is located above an upper surface of the side frame 2 and the support shaft 14*b* is faced toward an inner side of the loom. As for an attachment position, the support shaft 14*h* is located at a substantial center of the side frame 2 in the front and rear direction.

Each of the heddle frame guides 12 is supported on the corresponding side frame 2 via the bracket 14 in a form of being attached to a tip end portion of the support shaft 14*b* of the bracket 14. Therefore, as for a positional relationship in the width direction between the side frame 2 and the heddle frame guide 12, the heddle frame guide 12 is spaced from the inner surface 9 of the side frame 2 about by the bracket 14.

The heddle frame guide 12 has two guide portions 12*h* provided at an interval in an upper and lower direction (vertical direction) in a state where the heddle frame guide 12 is supported on the side frame 2 as described above. Each of the guide portions 12*b* has a plurality of guide grooves for guiding up-and-down movement of a plurality of heddle frames 11 provided for the loom. In the loom, each of the heddle frames 11 is provided with both sides thereof being guided to the guide grooves of the pair of heddle frame guides 12 and 12.

In this way, a position of the guide groove of each of the heddle frame guides 12 is a position in which the heddle frame 11 is guided on a side of each of the side frames 2 of the loom. The guide position is defined by a position of the side frame 2 (inner surface 9) due to the positional relationship between the side frame 2 and the heddle frame guide 12 as described above. Therefore, a part (surface) of the inner surface 9 of the side frame 2, to which the bracket 14 is attached, is a reference surface 10 for defining the guide position.

For reference, the specification of the loom is determined based on a weaving width of a fabric W to be woven. The heddle frame 11 mounted on the loom has a width corresponding to the specification (the greatest weaving width that can be woven) of the loom. Therefore, an interval between the pair of side frames 2 and 2 configured to support the pair of heddle frame guides 12 and 12 provided so as to guide the heddle frame 11 is set, taking into consideration a width of the heddle frame 11 and the positional relationship between the side frame 2 and the heddle frame guide 12. An interval between the pair of the reference surfaces 10 and 10 included in the pair of side frames 2 and 2 whose interval is set in such a way is also defined according to the interval between the side frames 2 and 2.

Further, as for the four beam members connecting the pair of side frames 2 and 2, the two beam members 3*a* and 3*h* are provided as beam members on the winding side (winding-side beam members 3*a* and 3*b*) arranged on the winding beam 8-side in the front and rear direction, and the two remaining beam members 3*c* and 3*d* are provided as beam members on the delivery side (delivery-side beam members 3*c* and 3*d*) arranged on the warp beam 6-side in the front and rear direction. The winding-side beam members 3*a* and 3*b* are arranged in different positions in the upper and lower direction, the upper beam member 3*a* is a so-called front top stay, and the lower beam member 3*b* is a so-called front bottom stay. The delivery-side beam members 3*c* and 3*d* are also arranged in different positions in the upper and lower direction, the upper beam member 3*c* is a so-called rear top stay, and the lower beam member 3*d* is a so-called rear bottom stay.

Note that, the front top stay 3*a* and the rear top stay 3*c* each have flanges formed at both end portions thereof. The flange is formed with a plurality of through-holes in which bolts for fixing are inserted. The bolts for fixing inserted in the through-holes of each of the flanges are inserted into through-holes formed to open to the inner surface 9 of the corresponding side frame 2 and are screwed with nuts, so that the front top stay 3*a* and the rear top stay 3*c* are fixed to each of the side frames 2 (inner surfaces 9). In this way, the front top stay 3*a* and the rear top stay 3*c* are fixed to attachment parts, which are attachment parts set on the inner surfaces 9 of each of the side frames 2, thereby connecting both the side frames 2 and 2.

The front bottom stay 3*b* and the rear bottom stay 3*d* are each a beam member having a substantially U-shaped section and each have end walls formed at both end portions so as to close end portions. The end wall is formed with a plurality of through-holes in which bolts for fixing are inserted. The bolts for fixing inserted in the through-holes of each of the end walls are inserted into through-holes formed to open to the inner surface 9 of the corresponding side frame 2 and are screwed with nuts, so that the front bottom stay 3*b* and the rear bottom stay 3*d* are fixed to each of the side frames 2 (inner surfaces 9). In this way, the front bottom stay 3*b* and the rear bottom stay 3*d* are fixed to attachment parts, which are attachment parts set on the inner surfaces 9 of each of the side frames 2, thereby connecting both the side frames 2 and 2.

A main shaft 16 of the loom is supported at both end portions by both the side frames 2 and 2 in a direction parallel to the front top stay 3*a* i.e., a direction parallel to a width direction of the loom (hereinafter, simply referred to as "width direction"). Note that, a support position of the main shaft 16 is a position between the front top stay 3*a* and the bracket 14 (heddle frame guide 12) in the front and rear direction, and is a position in which an upper end (upper edge) thereof is located near a lower surface of the front top stay 3*a*, in the upper and lower direction.

The loom also has a beating mechanism configured to rock a reed 5. In the beating mechanism, the reed 5 is supported on a rocking shaft 4 via a plurality of sley swords and the like. Further, the rocking shaft 4 is supported at both end portions by both the side frames 2 and 2 in a direction parallel to the width direction. Note that, a support position of the rocking shaft 4 is substantially the same position as the main shaft 16 in the front and rear direction, and is a position above the main shaft 16 and overlapping the front top stay 3*a* in the upper and lower direction.

The loom also has a winding mechanism configured to send the manufactured woven fabric W toward the winding beam 8 at a speed corresponding to a woven fabric density. The winding mechanism includes a cloth winding roll 15, and a pair of press rolls 15*b* and 15*b* provided to be pressed against the cloth winding roll 15 by means of a pressing mechanism (not shown). In addition, the cloth winding roll 15 is supported at both end portions by both the side frames 2 and 2 in a direction parallel to the width direction. Note that, a support position of the cloth winding roll 15 is a position on a side opposite to the main shaft 16 with respect to the front top stay 3*a* in the front and rear direction, and is a position overlapping the front top stay 3*a* in the upper and lower direction.

As for the frame 1 of the loom as described above, according to the present invention, at least one of the plurality of attachment parts of one or both of the pair of side frames is formed to be an offset attachment part located on a more inner side of the frame 1 than the reference surface 10, In the present embodiment, each of the attachment parts of the front top stay 3*a* and the rear top stay 3*c* on both the side frames 2 and 2 is formed as the offset attachment part. The frame 1 of the loom of the present embodiment is specifically described as follows.

As for each of the side frames 2, the inner surface 9 is formed such that a part of a range, which becomes the attachment part for the front top stay 3*a* as seen in the width direction, protrudes with respect to a part including the reference surface 10 so that the attachment part is located on an inner side of the frame 1 with respect to the reference surface 10. As a result, the attachment part is located on an inner side of the frame 1 with respect to the reference surface 10 and is formed as an offset attachment part 17 of the present invention. Specifically, in the present embodiment, the attachment part for the front top stay 3*a* is formed as the (first) offset attachment part 17.

As for the inner surface 9 of each side frame 2, the inner surface 9 is formed such that a part of a range, which becomes the attachment part for the rear top stay 3*c* as seen in the width direction, protrudes with respect to the part including the reference surface 10 so that the attachment part is located on an inner side of the frame 1 with respect to the reference surface 10. As a result, the attachment part is located on an inner side of the frame 1 with respect to the reference surface 10 and is formed as an offset attachment part 18 of the present invention. Specifically, in the present embodiment, the attachment part for the rear top stay 3*c* is also formed as the (second) offset attachment part 18.

Note that, in the present embodiment, the first offset attachment part 17 that is the attachment part for the front top stay 3*a* is formed over a range wider than a part, to which the front top stay 3*a* is attached, as seen in the width direction. Specifically, the first offset attachment part 17 is formed over a range including each support position of the main shaft 16, the rocking shaft 4 and the cloth winding roll 15, in addition to the part to which the front top stay 3*a* is attached.

Therefore, an inner sidewall (inner wall) of each side frame 2 is formed with through-holes 23*a*, 23*b* and 23*c*, in which bearings 22*a*, 22*b* and 22*c* for supporting the main shaft 16, the rocking shaft 4 and the cloth winding roll 15 are arranged, at portions corresponding to the first offset attachment part 17. Bearing holders 19, 20 and 21 for arranging the bearings 22*a*, 22*b* and 22*c* are each attached to each of the through-holes 23*a*, 23*b* and 23*c*. Further, the main shaft 16, the rocking shaft 4 and the cloth winding roll 15 are supported on both the side frames 2 and 2 by means of each of the bearings 22*a*, 22*b* and 22*c* arranged on each of the side frames 2 by the bearing holders 19, 20 and 21.

The bearing holders 19, 20 and 21 have the same configuration. Therefore, the bearing holder 20 for the rocking shaft 4 is exemplarily described. The bearing holder 20 is constituted by a cylindrical fitting/insertion portion 20*a* having a through-hole 20*c*, as a main body. The bearing holder 20 has a flange portion 20*b* formed on one end-side of the fitting/insertion portion 20*a* in an axis line direction.

Note that, as for the fitting/insertion portion 20*a*, the fitting/insertion portion 20*a* is formed so that an inner diameter of the through-hole 20*c* is large enough to accommodate the hearing 22*b* in a fitted state. However, the fitting/insertion portion 20*a* is formed so that the inner diameter of the through-hole 20*c* becomes smaller at an end portion on the one end-side. Specifically, the through-hole 20*c* is formed by a portion (accommodation portion) configured to accommodate the hearing 22*h* and a small-diameter portion on the one end-side with respect to the accommodation portion. Therefore, the fitting/insertion portion 20*a* has an end wall 20*e*, in which the small-diameter portion of the through-hole 20*c* is formed, at an end portion on one end portion-side. An inner diameter of the small-diameter portion of the through-hole 20*c* formed in the end wall 20*e* substantially coincides with an outer diameter of a shaft portion of the rocking shaft 4, which is supported by the bearing 22*b*.

The flange portion 20*b* is formed on the one end-side of the fitting/insertion portion 20*a*, as described above, and is formed to be thicker than a thickness of the end wall 20*e* of the fitting/insertion portion 20*a*. Specifically, a thickness of the flange portion 20*b* is set so that a difference from the thickness of the end wall 20*e* is about a half of a width of the bearing 22*b*. The flange portion 20*b* is formed with a plurality of through-holes in which bolts 25 for fixing the bearing holder 20 to the side frame 2 (first offset attachment part 17) are inserted.

Further, the bearing holder 20 is fixed to the side frame 2 in a state where the fitting/insertion portion 20*a* is fitted in the through-hole 23*b*. Therefore, the through-hole 23*b* is formed so that an inner diameter thereof is sized to correspond to an outer diameter of the fitting/insertion portion 20*a*. In addition, the bearing holder 20 is fixed to the side frame 2 by screwing the bolts 25 for fixing inserted in the through-holes of the flange portion 20*b* into female screw holes formed to open to the corresponding offset attachment part 17.

The bearing 22*b* is fitted in the accommodation portion of the through-hole 20*c*, and is accommodated in the bearing holder 20 in a state where one end-side thereof is in contact with the end wall 20*e*. In the accommodated state, the beating 22*b* is in a state where a center of a width thereof substantially coincides with a position of an end face of the flange portion 20*b* of the bearing holder 20 facing toward the other end-side, in the axis line direction. Therefore, in the state where the bearing holder 20 is attached to the side frame 2 as described above, the bearing 22*b* is in the state where the center of the width thereof substantially coincides with a position of the offset attachment part 17 of the side frame 2, in the width direction of the loom. Specifically, according to the configuration, a position of the bearing 22*b* that supports the shaft portion of the rocking shaft 4, i.e., the support position of the rocking shaft 4 is located on a more inner side of the frame 1 in the width direction, as compared to a case where the same bearing holder is attached to the side frame 2 so that the flange portion abuts against the reference surface 10.

As described above, as for the frame 1 of the loom of the present embodiment, the attachment parts of both the side frames 2 and 2 for the front top stay 3*a* and the rear top stay 3*c* are formed to be the offset attachment parts 17 and 18. Thereby, the front top stay 3*a* and the rear top stay 3*c* are formed smaller in length dimension, as compared to the frame of the related art where the attachment parts are formed in the same position as the reference surface 10 in the width direction. Therefore, as compared to the configuration of the related art, the frame 1 is configured so that the front top stay 3*a* and the rear top stay 3*c* are difficult to bend in the upper and lower direction and in the front and rear direction, and is accordingly difficult to vibrate in the upper and lower direction and in the front and rear direction, as a whole, so that the vibration-proof characteristic against the beating vibrations is improved.

Further, in the present embodiment, the attachment part for the front top stay 3*a* is formed to be the offset attachment part 17, and the attachment part to which the upper beam member 3*a* of the two winding-side beam members 3*a* and 3*b* provided in different positions in the upper and lower direction is attached is formed to be the offset attachment part 17. In this way, since the front top stay 3*a*, which is more susceptible to an influence of the beating vibrations, is difficult to bend as described above, the vibration-proof characteristic of the frame 1 is accordingly improved more effectively.

Further, in the present embodiment, in a case where the front top stay 3*a* is formed as the target beam member, the offset attachment part 17 is formed over the part including each support position of the main shaft 16, the rocking shaft 4 and the cloth winding roll 15, as seen in the width direction, in addition to the part to which the front top stay 3*a* is attached, and each side frame 2 is formed so that parts before and after the attachment part on the inner surface 9 for the front top stay 3*a* protrude with respect to the part including the reference surface 10. Thereby, as compared to a case where only a part of a range becoming the attachment part as seen in the width direction further protrudes than the reference surface 10, since the dimension of the offset attachment part 17 in the front and rear direction is larger, each side frame 2 is formed so that the part of the inner wall including the attachment part is difficult to bend in the front and rear direction.

Further, in the present embodiment, the offset attachment part 17 is formed so that the protruding amount is the same over the entire offset attachment part so as for the protruding part to be flat, and the protruding amount at the parts before and after the attachment part is the same. Thereby, as compared to a case where even when the parts before and after the attachment part are formed to further protrude than the part including the reference surface 10, the protruding amount at the parts before and after the attachment part is different, each side frame 2 is formed so that the part of the inner wall including the attachment part is difficult to bend toward both sides in the front and rear direction. Therefore, since each side frame 2 itself is difficult to bend as described above, the vibration-proof characteristic of the frame 1 is accordingly improved more effectively.

Further, in the present embodiment, the attachment part for the rear top stay 3*c* is formed to be the offset attachment part 18, and the attachment part to which the upper beam member 3*c* of the two delivery-side beam members 3*c* and 3*d* provided in different positions in the upper and lower direction is attached is formed to be the offset attachment part 18. Therefore, the vibration-proof characteristic against beam vibrations of the frame 1 is accordingly improved more effectively.

For reference, as for the beam vibrations, in the loom, it is known that since the tension of the warp T varies due to an opening motion or a beating operation during one cycle of weaving, the tension variation becomes a vibrating force to cause vibrations on the warp beam 6 in a rotating direction and a pull-out direction (upper and lower direction) of the warp T. Since the beam vibrations act on each side frame 2 on the delivery-side, as the vibrating force, the rear top stay 3*c* and the rear bottom stay 3*d* that are the delivery-side beam members are susceptible to the influence of the beam vibrations. In the meantime, since each side frame 2 is strongly fixed to the setup surface of the loom by the anchor bolts, the vibrations are more likely to occur on the upper part than on the lower part. For this reason, when comparing the two delivery-side beam members provided in different positions in the upper and lower direction, the rear top stay 3*c* is more susceptible to the influence of the beam vibrations, as compared to the rear bottom stay 3*d*.

Although one embodiment of the frame of a loom of the present invention has been described, the frame of a loom of the present invention is not limited to the above embodiment, and can be implemented in following modified embodiments.

(1) In the above embodiment, as for the offset attachment part 17 in the case where the front top stay 3*a* is formed as the target beam member, the offset attachment part 17 is formed over the range including each support position of the main shaft 16, the rocking shaft 4 and the cloth winding roll 15, as seen in the width direction, in addition to the part to which the front top stay 3*a* is attached. However, in the frame of a loom of the present invention, it is sufficient for the offset attachment part to be formed within a range in which at least the target beam member is attached. Therefore, even when the front top stay 3*a* is formed as the target beam member, as described above, the offset attachment part may be formed over a range of only the part to which the front top stay 3*a* is attached or may be formed over a range including one or two of the support positions.

(2) In the above embodiment, the attachment parts for the front top stay 3*a* and the rear top stay 3*c* are formed as the offset attachment parts 17 and 18 of the present invention. Specifically, the upper beam members 3*a* and 3*c* of the two beam members 3*a* and 3*b* on the winding-side and the two beam members 3*c* and 3*d* on the delivery-side are formed as the target beam members, and the attachment parts are formed as the offset attachment parts 17 and 18. However, in the frame of a loom of the present invention, the frame may also be configured such that at least one beam member of the plurality of beam members connecting both the side frames 2 and 2 is formed as the target beam member and the attachment part for the target beam member is formed as the offset attachment part.

Therefore, in the case of the frame 1 configured as described in the above embodiment, for example, as for the two beam members 3*a* and 3*b* on the winding-side and/or the two beam members 3*c* and 3*d* on the delivery-side, instead of the above embodiment where the upper beam members 3*a* and 3*c* are formed as the target beam members, the lower beam members 3*b* and 3*d* may be formed as the target beam members and the attachment parts therefor may be formed as the offset attachment parts. In addition, only the beam member on one of the winding-side and the delivery-side may be formed as the target beam member and the attachment part may be formed as the offset attachment part. Further, all of the beam members 3*a*, 3*b*, 3*c* and 3*d* of the frame 1 may be formed as the target beam members, and all of the attachment parts thereof may be formed as the offset attachment parts.

(3) In the above embodiment, on both sides of the pair of side frames 2 and 2, the attachment parts for the target beam members are formed as the offset attachment parts of the present invention. Specifically, both the attachment parts on both sides for the target beam members are formed as the offset attachment parts. However, in the frame of a loom of the present invention, the frame may also be configured such that only one of both the attachment parts for the target beam members is formed as the offset attachment part.

In the case where the two or more beam members are formed as the target beam members, like the above embodiment, the present invention is not limited to the configuration where the attachment parts for all of the target beam members are formed to be the same, like the above embodiment. For example, the attachment parts for some of the target beam members may be formed to be different from the attachment part for another target beam member. For instance, in the case where the two beam members are formed as the target beam members, like the above embodiment, both the attachment parts for one target beam member may be formed as the offset attachment parts, and only one of the attachment parts for the other target beam member may be formed as the offset attachment part.

In a case where the attachment parts for the two or more target beam members are formed to be the offset attachment parts only on one side, the attachment parts becoming the offset attachment parts are not limited to a configuration where all are the attachment parts of the side frame on the same side. For example, the offset attachment parts for some of the target beam members may also be formed as the attachment parts of the side frame on an opposite side to the offset attachment parts for the other target beam members.

(4) In the above embodiment, the frame 1 of a loom to which the present invention is applied has the configuration where both the side frames 2 and 2 are connected by means of the four beam members 3*a*, 3*b*, 3*c* and 3*d*. However, depending on looms, a frame may have a configuration where both the side frames are connected by means of the three or less or five or more beam members. The present invention can also be applied to the frame of a loom.

Note that, the present invention is not limited to any embodiment described above, and can be changed as appropriate without departing from the gist thereof.

What is claimed is:

1. A frame of a loom comprising a pair of side frames connected to each other by means of a plurality of beam members attached to attachment parts on inner surfaces of each of the side frames, and each configured to support a heddle frame guide configured to guide up-and-down movement of a heddle frame of an opening device, the frame of a loom being characterized in that at least one of the pair of side frames has, as a reference surface, a part located in a position of the inner surface in which the heddle frame guide in a warp direction is supported and the attachment part to which at least one of the plurality of beam members is attached is formed to be an offset attachment part located on a more inner side of the frame than the reference surface.

2. The frame of a loom according to claim 1, wherein the plurality of beam members comprises two winding-side beam members provided in different positions in an upper and lower direction on a further winding-side than the heddle frame guide, and the offset attachment part is the attachment part to which an upper beam member of the winding-side beam members is attached.

* * * * *